US010674260B1

(12) United States Patent
Tanabian et al.

(10) Patent No.: US 10,674,260 B1
(45) Date of Patent: Jun. 2, 2020

(54) SMART SPEAKER SYSTEM WITH MICROPHONE ROOM CALIBRATION

(71) Applicant: Microsoft Technology Licensing, LLC, Redmond, WA (US)

(72) Inventors: Mohammad Mahdi Tanabian, Kirkland, WA (US); Timothy Allen Jakoboski, Woodinville, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/197,070

(22) Filed: Nov. 20, 2018

(51) Int. Cl.

| | |
|---|---|
| ***H04R 3/00*** | (2006.01) |
| ***H04R 23/02*** | (2006.01) |
| ***H04R 23/00*** | (2006.01) |
| ***H04R 1/40*** | (2006.01) |

(52) U.S. Cl.
CPC ..... *H04R 3/005* (2013.01); *H04R 1/406* (2013.01); *H04R 23/008* (2013.01); *H04R 23/02* (2013.01)

(58) Field of Classification Search
None
See application file for complete search history.

(56) References Cited

U.S. PATENT DOCUMENTS

| | | | | |
|---|---|---|---|---|
| 7,995,768 | B2 | 8/2011 | Miki et al. | |
| 8,848,942 | B2 | 9/2014 | Radcliffe et al. | |
| 8,947,347 | B2 | 2/2015 | Mao et al. | |
| 8,983,089 | B1 * | 3/2015 | Chu | H04R 3/005 381/58 |
| 9,489,948 | B1 | 11/2016 | Chu et al. | |
| 9,668,048 | B2 | 5/2017 | Sakri et al. | |
| 9,689,960 | B1 * | 6/2017 | Barton | G01S 3/8083 |
| 2005/0232447 | A1 | 10/2005 | Shinozuka et al. | |
| 2014/0270202 | A1 * | 9/2014 | Ivanov | H04R 29/005 381/58 |
| 2014/0314251 | A1 * | 10/2014 | Rosca | H04R 3/005 381/92 |

(Continued)

FOREIGN PATENT DOCUMENTS

| | | | |
|---|---|---|---|
| WO | 2017184149 | A1 | 10/2017 |

OTHER PUBLICATIONS

"International Search Report and Written Opinion Issued in PCT Application No. PCT/US2019/061055", dated Feb. 12, 2020, 13 pages.

*Primary Examiner* — Kenny H Truong
(74) *Attorney, Agent, or Firm* — Schwegman Lundberg & Woessner, P.A.

(57) ABSTRACT

Systems and methods can be implemented to include a speaker system with microphone room calibration in a variety of applications. The speaker system can be implemented as a smart speaker. The speaker system can include a microphone array having multiple microphones, one or more optical sensors, one or more processors, and a storage device comprising instructions. The one or more optical sensors can be used to determine distances of one or more surfaces to the speaker system. Based on the determined distances, an algorithm to manage beamforming of an incoming voice signal to the speaker system can be adjusted or selected one or more microphones of the microphone array can be turned off, with an adjustment of an evaluation of the voice signal to the microphone array to account for the one or more microphones turned off. Additional systems and methods are disclosed.

17 Claims, 4 Drawing Sheets

(56) References Cited

U.S. PATENT DOCUMENTS

| | | | | |
|---|---|---|---|---|
| 2014/0362253 | A1* | 12/2014 | Kim | H04N 5/262<br>348/231.4 |
| 2017/0366909 | A1 | 12/2017 | Mickelsen et al. | |
| 2018/0226085 | A1 | 8/2018 | Morton et al. | |
| 2018/0233129 | A1 | 8/2018 | Bakish et al. | |
| 2019/0212441 | A1* | 7/2019 | Casner | B25J 5/005 |

* cited by examiner

SMART SPEAKER SYSTEM WITH MICROPHONE ROOM CALIBRATION

TECHNICAL FIELD

Embodiments described herein generally relate to methods and apparatus related to speaker systems, in particular smart speaker systems.

BACKGROUND

A smart speaker is a type of wireless speaker and voice command device with an integrated virtual assistant, where a virtual assistant is a software agent that can perform tasks or services for an individual. In some instances, such as associated with Internet access, the term "chatbot" is used to refer to virtual assistants. A virtual assistant can be implemented as artificial intelligence that offers interactive actions and handsfree activation of the virtual assistant to perform a task. The activation can be accomplished with the use of one or more specific terms, such as the name of the virtual assistant. Some smart speakers can also act as smart devices that utilize Wi-Fi, Bluetooth, and other wireless protocol standards to extend usage beyond typical speaker applications, such as to control home automation devices. This usage can include, but is not be limited to, features such as compatibility across a number of services and platforms, peer-to-peer connection through mesh networking, virtual assistants, and others. Voice activated smart speakers are speakers combined with a voice recognition system to which a user can interact.

In a voice activated smart home speaker, its microphone array can be optimally placed to allow for far-field beam forming of incoming voice commands. This placement of this microphone array can be in a circular pattern. Although this allows for an optimized omni-directional long-range voice pickup, the environments in which these devices are used are often not omni-directional open spaces. The introduction of hard and soft acoustic surfaces creates both absorptive and reflective surfaces that can alter the reception of voice commands. These acoustic surfaces provide a reverberation creating a secondary overlapping signal, which is typically undesirable. For example, a standard placement of a smart speaker against a hard wall, such as a ceramic back splash in a kitchen, creates indeterminate voice reflections for which the device needs to account without knowing the conditions of the room.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, mechanical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, image sensors can be implemented onboard a smart speaker system to detect room conditions, allowing for calibration of the microphones of the smart speaker system or for deactivation of one or more of the microphones to prevent acoustical reflections (reverberation). The use of onboard image sensors allows the speaker device to calibrate the microphone array to minimize the voice reflections from nearby surfaces, where such reflections reduce voice recognition accuracy. By using onboard optical sensors, close proximity flat surfaces, such as walls, can be calibrated, that is taken into account, by turning off selected microphones and an onboard process can then adjust a far-field microphone algorithm for the missing microphones. For an array of microphones, a far-field model regards the sound wave as a plane wave, ignoring the amplitude difference between received signals of each array element. A far field region may be greater than two meters from the microphone array of the speaker system.

The optical sensors of the speaker system can be implemented as image sensors such self-lit cameras onboard the speaker system, which allows the reading of the room in which the speaker system is located by recognizing how much light is reflecting off of the area around the speaker system. The self-lit cameras can be infrared (IR)-lit cameras. Signal processing in the speaker system can use the reading of the room from the light detection to determine proximity of the speaker system to one or more surfaces of the room. If the proximity is less than a threshold distance, signal processing associated with receiving voice signals at the microphone array can be used to take into account acoustic reflections from these surfaces. The threshold distance is a distance beyond which acoustic reflections from these surfaces are negligible or at least at acceptable levels for processing of the voice signals directly from a user source.

Figure 1A:
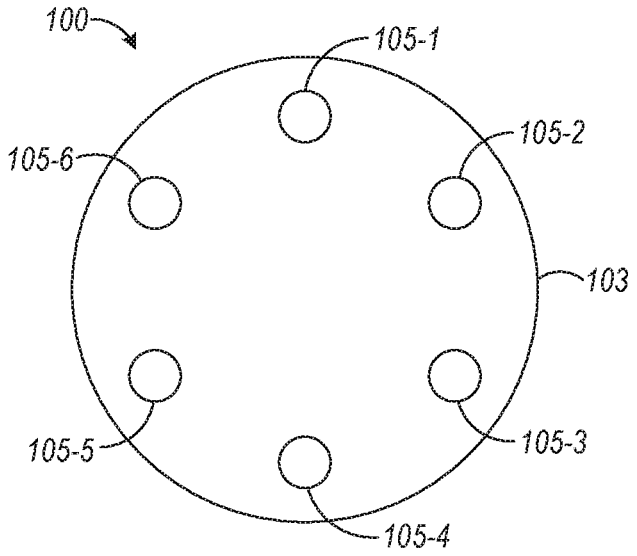
FIG. 1A is a top view of a speaker system having a microphone array, in accordance with various embodiments.

FIG. 1A is a top view of a speaker system 100 having a microphone array. The microphone array can include multiple microphones 105-1, 105-2, 105-3, 105-4, 105-5, and 105-6 on a housing 103. Microphones 105-1, 105-2, 105-3, 105-4, 105-5, and 105-6 may be integrated in housing 103. Though speaker system 100 is shown with six microphones, a speaker system can be implemented with less than or more than six microphones. Though the microphone array is shown in a circular pattern, other patterns may be implemented, such as but not limited to a linear array of microphones. Speaker system 100 can be implemented as a voice activated smart home speaker system having microphone room calibration capabilities.

Figure 1B:
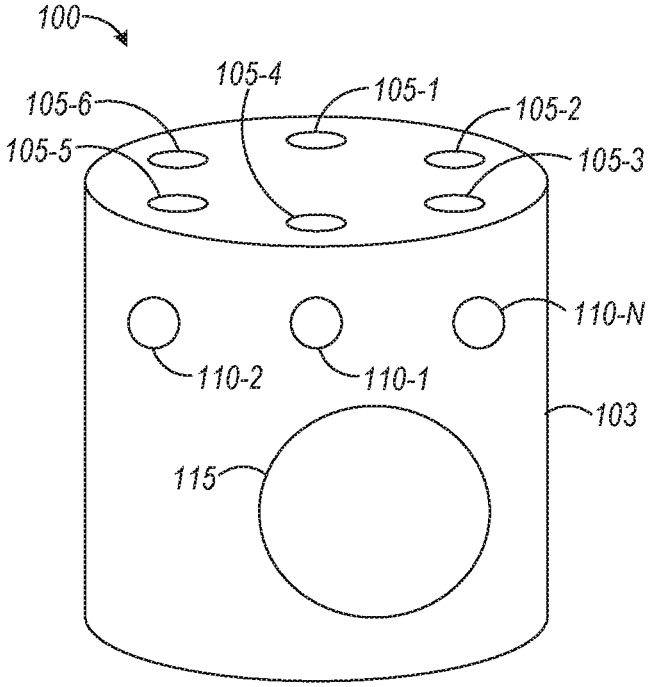
FIG. 1B is a perspective view of the speaker system of FIG. 1A, in accordance with various embodiments.

FIG. 1B is a perspective view of speaker system 100 of FIG. 1A illustrating components of speaker system 100. In addition to microphones 105-1, 105-2, 105-3, 105-4, 105-5, and 105-6 and a speaker 115, speaker system 100 can include optical sensors 110-1, 110-2 . . . 110-N. Optical sensors 110-1, 110-2 . . . 110-N can be used to receive optical signals to determine distances of one or more surfaces to speaker system 100. The received optical signals are reflections off surfaces near speaker system 100 of optical signals generated by optical sensors 110-1, 110-2 . . . 110-N. Each of the optical sensors 110-1, 110-2 . . . 110-N can include an optical source and an optical detector. Each of the optical sources can be realized by an infrared source and each of the optical detectors can be realized by an infrared detector. Other optical components such as mirrors and lenses can be used in the optical sensors 110-1, 110-2 . . . 110-N. Optical sensors 110-1, 110-2 . . . 110-N can be integrated in housing 103 or disposed on housing 103. Though housing 103 is shown as a cylindrical structure, housing 103 may be implemented in other structural forms such as but not limited to a cube-like structure.

Though not shown in FIGS. 1A-1B, speaker system 100 can include a memory storage device and a set of one or more processors within housing 103 of speaker system 100. The positions of optical sensors 110-1, 110-2 . . . 110-N and microphones 105-1, 105-2, 105-3, 105-4, 105-5, and 105-6 can be fixed. The locations of these components integrated in or on housing 103 can be stored in the memory storage device. These locations can be used in calibrating speaker system 100 and controlling microphones 105-1, 105-2, 105-3, 105-4, 105-5, and 105-6 to enhance voice recognition accuracy.

The set of processors can execute instructions stored in the memory storage device to cause the speaker system to perform operations to calibrate the speaker system to detect room conditions. The set of processors can be used to determine distances of one or more surfaces to speaker system 100 in response to optical signals received by optical sensors 110-1, 110-2 . . . 110-N. The optical signals can originate from optical sensors 110-1, 110-2 . . . 110-N. The distances can be determined using times that signals are generated from speaker system 100, which can be a smart speaker system, and times that reflected signals associated with the generated signals are received at speaker system 100, such as using time differences between the generated signals and the received reflected signals. The set of processors can be used to adjust an algorithm to manage beamforming of an incoming voice signal to the speaker system based on the determined distances, or turn off selected one or more microphones of the microphone array based on the determined distances and adjust evaluation of the voice signal to the microphone array to account for the one or more microphones turned off.

The locations of microphones 105-1, 105-2, 105-3, 105-4, 105-5, and 105-6 are known parameters in the processing logic of speaker system 100, where these locations provide a pattern, where software of the processing logic can use a triangulation methodology to determine sound from a person. The variations between calibrated microphones 105-1, 105-2, 105-3, 105-4, 105-5, and 105-6 of the microphone array can be used to more accurately decipher the sound that is coming from a person at a longer range. These variations can include variations in the timing of a voice signal received at each of microphones 105-1, 105-2, 105-3, 105-4, 105-5, and 105-6. These timing differences and the precise locations of each microphone in relationship to the other microphones of the microphone array can be used to generate a probable location of the source of the voice signal. An algorithm can use beamforming to listen more to the probable location than elsewhere in the room as input to voice recognition to execute tasks identified in the voice signal.

Beamforming, which is a form of spatial filtering, is a signal processing technique that can be used with sensor arrays for directional signal transmission or reception. Signals from microphones 105-1, 105-2, 105-3, 105-4, 105-5, and 105-6 can be combined in a manner such that signals at particular angles experience constructive interference while others experience destructive interference. Beamforming of the signals from microphones 105-1, 105-2, 105-3, 105-4, 105-5, and 105-6 can be used to achieve spatial selectivity, which can be based on the timing of the received voice signals at each of microphones 105-1, 105-2, 105-3, 105-4, 105-5, and 105-6 and the locations of these microphones. This beamforming can include weighting the output of each of microphones 105-1, 105-2, 105-3, 105-4, 105-5, and 105-6 in the processing of the received voice signals. Beamforming provides a steering mechanism that effectively provides microphones 105-1, 105-2, 105-3, 105-4, 105-5, and 105-6 the ability to steer the microphone array input.

With speaker system 100 located as a position in a room that is relatively removed from surfaces that provide strong reflections, the processing of a received voice signal can handle the relatively small reflections off of walls. However, when smart speaker systems, such as speaker system 100, are used in a home environment, the speaker system is typically placed in a location in a room, where the location is convenient for the user. Typically, this convenient location is against or near a wall or a corner of the room. In this location, the reflections of voice signals and signals from the speakers of speaker system 100 can be relatively strong, affecting the ability to provide accurate voice recognition of the voice signals received by of speaker system 100.

Figure 2:
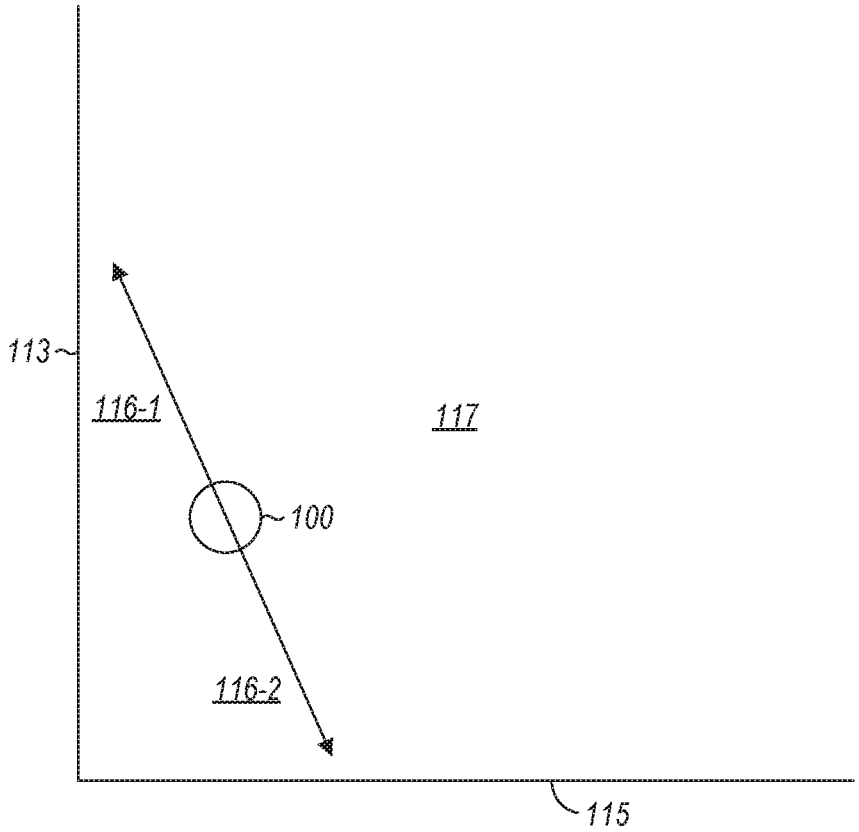
FIG. 2 illustrates an example of a placement of the speaker system of FIGS. 1A-1B in a room, in accordance with various embodiments.

FIG. 2 illustrates an example of a placement of speaker system 100 of FIGS. 1A-1B in a room. Speaker system 100 is shown relative to a wall 113 and a wall 115. Region 116-1 and region 116-2 are regions in which the distances from walls 113 and 115 to speaker system 100, as measured by optical sensors 110-1, 110-2 . . . 110-N of speaker system 100, are less than a threshold distance. The threshold distance being a distance from a reflecting surface, below which the reflecting surface is deemed to contribute to reception of reflected acoustic signals, by speaker system 100, that are considered to be at unacceptable levels. As speaker system 100 is moved down along wall 113 towards the corner defined by the intersection of walls 113 and 115, region 116-2 extends further out away from wall 113 and region 116-1 is reduced towards wall 115. As speaker system 100 is moved in towards wall 113, region 116-2 is reduced towards wall 113 and region 116-1 extends further away from wall 115. Region 117 is a region in which the speaker system 100 does not receive unacceptable reflections either due to the open space of region 117 or due to reflections from walls 113 and 115 to speaker system 100, as measured by optical sensors 110-1, 110-2 . . . 110-N of speaker system 100, being greater than the threshold distance. The algorithm for processing voice signals received by the microphone array of speaker system 100 can be adjusted can be adjusted to account for the reflections received from regions 116-1 and 116-2.

Figure 3:
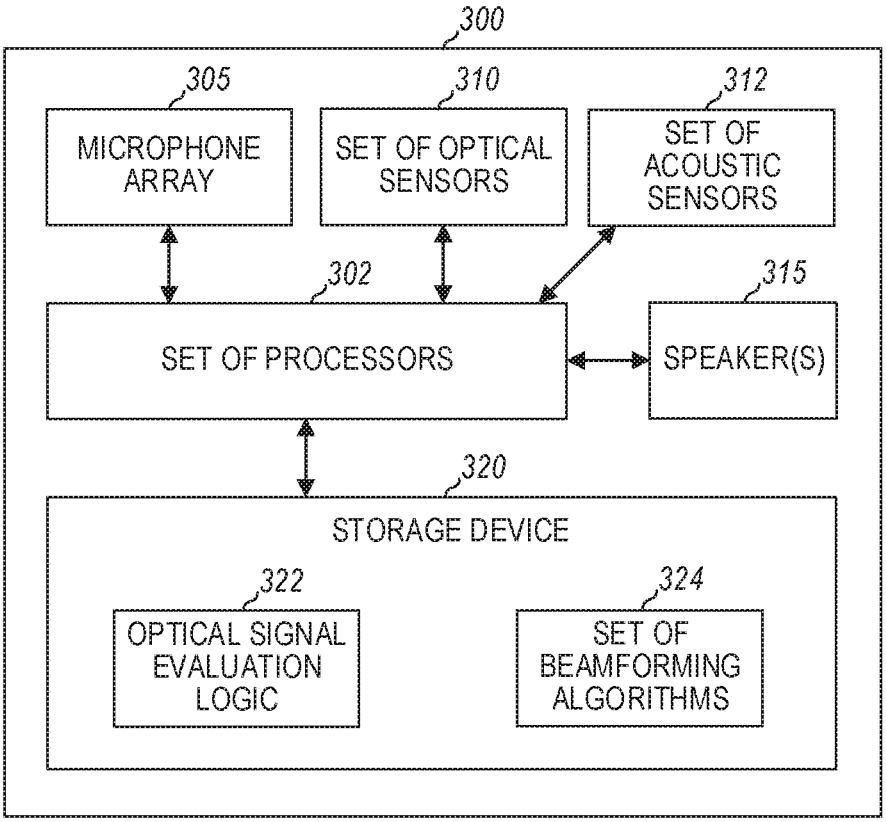
FIG. 3 is a block diagram of an example speaker system with microphone room calibration capabilities, in accordance with various embodiments.

FIG. 3 is a block diagram of an embodiment of an example speaker system 300 with microphone room calibration capabilities. Speaker system 300 may be implemented similar or identical to speaker system 100 of FIGS. 1A-1B. Speaker system 300 can be implemented as an activated smart home speaker with microphone room calibration capabilities. Speaker system 300 can include a microphone array 305 having multiple microphones and a set of optical sensors 310. Microphone array 305 having multiple microphones and the set of optical sensors 310 can operate in conjunction with or under control of a set of processors 302. The set of processors 302 can also control speaker(s) 315 to provide an acoustic output such as music or other user-related sounds. Speaker(s) 315 can be one or more speakers.

Speaker system 300 can include a storage device 320, which can store data, instructions to operate speaker system 300 to perform tasks in addition to providing acoustic output from speaker(s) 315, and other electronic information. Instructions to perform tasks can be executed by the set of processors 302. The stored instructions can include optical signal evaluation logic 322 and a set of beamforming algorithms 324, along with other instructions to perform other functions. Speaker system 300 can include instructions for operational functions to perform as a virtual assistant including providing the capability for speaker system 300 to communicate over the Internet or other communication network.

Optical signal evaluation logic 322 can include logic to determine distances from speaker system 300 to surfaces from generating optical signals from the set of optical sensors 310 and detecting returned optical signals by the set of optical sensors 310. The sequencing of the operation of each optical sensor can be controlled by the set of processors 302 executing instructions in the optical signal evaluation logic 322. The determined distances can be stored in the storage device 320 for use by any of the beamforming algorithms in the set of beamforming algorithms 324.

In an embodiment, the set of beamforming algorithms 324 may include only one beamforming algorithm, whose parameters are modified in response to the determined distances. The one beamforming algorithm, before parameters are modified, can be a beamforming algorithm associated with speaker system 300 being situated in an open space, that is, sufficiently far from surfaces such that acoustic reflections are not significant or are effectively eliminated by normal filtering associated with microphones of a speaker system. The initial parameters include the locations of each microphone of microphone array 305 relative to each other and can include these locations relative to a reference location.

The algorithm can be adjusted by redefining the algorithm to change the manner in which the algorithm handles the microphones of microphone array 305 such as depreciating the reading from one or more microphones and amplifying one or more to the other microphones of microphone array 305. The allocation of emphasis of the outputs from the microphones of microphone array 305 can be based on the determined distances, from operation of optical signal evaluation logic 322, mapped to the microphones of microphone array 305. In an embodiment, one approach to the allocation of emphasis can include turning off one or more microphones of the microphone array based on the determined distances and adjusting evaluation of the voice signal to the microphone array to account for the one or more microphones turned off. This adjusted evaluation can include beamforming defined by the microphones not turned off. These techniques can be applied in instances where the set of beamforming algorithms includes more than one algorithm.

Speaker system 300 can be arranged with a one-to-one mapping of an optical sensor of the set of optical sensors 315 with a microphone of microphone array 305. With the positions of the microphones of microphone array 305 and the positions of the optical sensors of the set of optical sensors 315 known, the determined distances to one or more surfaces from speaker system 300 can be evaluated to provide a mapping of distance with respect to each microphone with the number of optical sensors being different from the number of microphones.

The set of processors 302 can execute instructions in the set of beamforming algorithms 324 to cause the speaker system to perform operations to adjust a beamforming algorithm to manage beamforming of an incoming voice signal to speaker system 300 based on the determined distances, using optical signal evaluation logic 322, or turn off selected one or more microphones of microphone array 305 based on the determined distances and adjust evaluation of the voice signal to microphone array 305 to account for the one or more microphones turned off. The algorithm to manage beamforming of the incoming voice signal can be selected from the set of beamforming algorithms 324. The selection may depend on the number of microphones of microphone array 305. Alternatively, each algorithm of the set of beamforming algorithms 324 can be used and evaluated to apply the algorithm with the best results. The operations to adjust the algorithm (the selected algorithm or each algorithm applied) or turn off selected one or more microphones can include a comparison of the determined distance, for each surface of the one or more surfaces detected with the set of optical sensors 310, with a threshold distance for a speaker system to a reflective surface.

Operations to adjust the algorithm can include adjustment of a weight of an input to the algorithm from each microphone of a number of microphones of the microphone array based the determined distances by optical signal evaluation logic 322. Alternatively, the algorithm can be used to adjust individual gain settings of each microphone of microphone array 305 to provide variation of the outputs from the microphones based on the determined distances.

With the set of beamforming algorithms including multiple beamforming algorithms, operations to adjust the current algorithm can include retrieval of an algorithm, from the set of beamforming algorithms 324 in storage device 320, corresponding to a shortest distance of the determined distances and use of the retrieved algorithm to manage the beamforming of the incoming voice signal. The set of beamforming algorithms can include a specific beamforming algorithm for each combination of microphones of microphone array 305. These combinations can include all microphones of microphone array 305 and combinations corresponding to remaining microphones with one or more microphones effectively removed from microphone array 305 for all possible removed microphones except the case of all microphones removed. The beamforming algorithm corresponding to the shortest distance is one at microphones removed from the algorithm, where the removed microphones are mapped to the shortest distance.

With a number of microphones turned off, adjustment of the evaluation of the voice signal to microphone array 305 can include performance of the evaluation with the number of microphones in the evaluation reduced by the number of microphones turned off by defining evaluation parameters by the microphones of the microphone array that remain in an on status. These evaluation parameters include the locations of the microphones that remain in the on status, which depending on the timing of voice signals received at the on microphones, can result in adjusting the beamforming weights.

Optionally, speaker system 300 can include a set of acoustic sensors 312 with each acoustic sensor having an acoustic transmitter and an acoustic receiver. The acoustic sensors of the set of acoustic sensors 312 can be used to provide additional information regarding surfaces determined from probing by the optical sensors of the set of optical sensors 310. Acoustic signals generated by the acoustic transmitters of the set of acoustic sensors 312 and received by the acoustic receivers of the set of acoustic sensors 312 after reflection from surfaces can vary due to the nature of the surface, in addition to distances from the surfaces. Hard surfaces tend to provide stronger reflected acoustic signals than softer surfaces. The analysis can be used with the data from the set of optical sensors 310 to map the room in which the speaker system is disposed. Each acoustic sensor of the set of acoustic sensors 312 can be located with a different optical sensor of the set of optical sensors 310. The set of acoustic sensors 312 can be controlled by the set of processors 302 using instructions stored in storage device 320. Alternatively, microphones of microphone array 305 of speaker system 300 and one or more speakers 315 of speaker system 300 can be used to provide the additional information regarding surfaces determined from probing by the set of optical sensors 310. Such use of microphone array 305 and speakers 315 can be controlled by the set of processors 302 using instructions stored in storage device 320.

Figure 4:
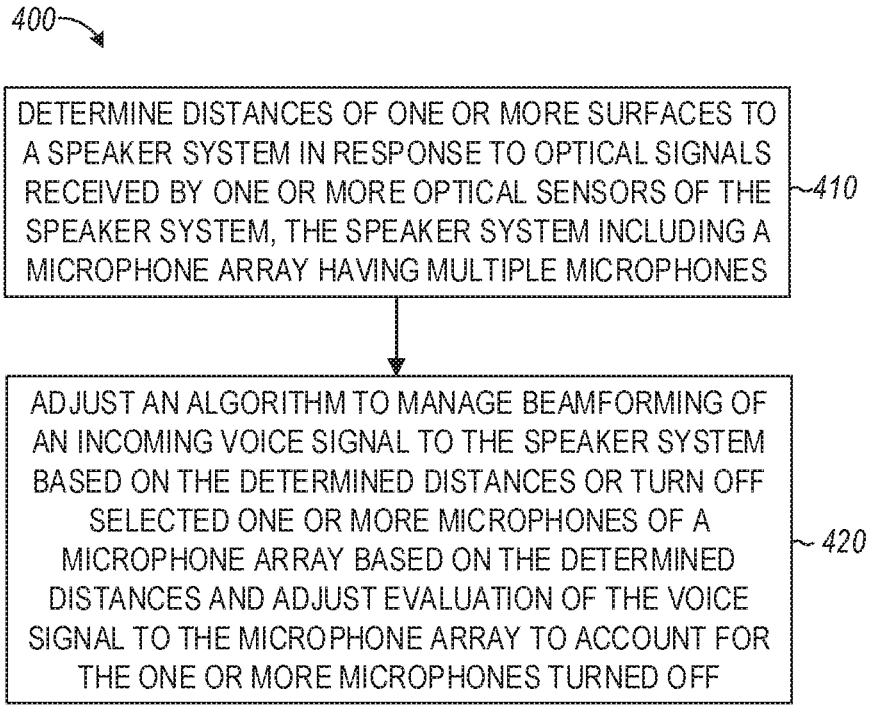
FIG. 4 is a flow diagram of features of an example method of calibration of a speaker system with respect to a location in which the speaker system is disposed, in accordance with various embodiments.

FIG. 4 is a flow diagram of features of an embodiment of an example method 400 of calibration of a speaker system with respect to a location in which the speaker system is disposed. Method 400 can be realized as a processor implemented method using a set of one or more processors. In addition to a speaker and the set of processors, the speaker system can include a microphone array having multiple microphones and one or more optical sensors. Method 400 can be performed to calibrate the speaker system with the speaker system placed randomly in a room to increase accuracy of determining voice input to the speaker system. At 410, distances of one or more surfaces to the speaker system can be determined in response to optical signals received by the one or more optical sensors of the speaker system. The optical signals can be generated by optical sources of the one or more optical sensors and the optical signals, after reflection from a surface separate from the speaker system, can be received by optical detectors of the one or more optical sensors. The optical signals can be infrared signals. The infrared signals can range in wavelength from about 750 nm to about 920 nm using standard sensors.

At 420, an algorithm is adjusted to manage beamforming of an incoming voice signal to the speaker system based on the determined distances or selected one or more microphones of the microphone array are turned off based on the determined distances and evaluation of the voice signal to the microphone array is adjusted to account for the one or more microphones turned off. Adjusting the algorithm or turning off selected one or more microphones can include comparing the determined distance, for each surface of the one or more surfaces, with a threshold distance for a speaker system to a reflective surface. The threshold distance can be stored in memory storage devices of the speaker distance. The threshold distance provides a distance at which acoustic reflections from surfaces to the speaker system are small compared to a voice signal from a person interacting with the speaker system. These acoustic reflections may include the voice signal reflected from one or more surfaces near the speaker system. These acoustic reflections may also include output from the speaker system that reflects from the one or more surfaces near the speaker system. The output from the speaker system can include music or other produced sounds generated by the speaker system.

Adjusting the algorithm can include adjusting a weight of an input to the algorithm from each microphone of a number of microphones of the microphone array based the determined distances. Depending on the determined distances, the number of weights adjusted may be less than the total number of microphones of the microphone array. Depending on the determined distances, each weight associated with each microphone of the microphone array can be adjusted. Adjusting the algorithm can include retrieving, from a storage device, an algorithm corresponding to a shortest distance of the determined distances and using the retrieved algorithm to manage the beamforming of the incoming voice signal.

Adjusting the evaluation of the voice signal to the microphone array can include performing the evaluation with the number of microphones in the evaluation reduced by the number of microphones turned off by defining evaluation parameters for the microphones of the microphone array that remain in an on status. Adjusting the algorithm and/or adjusting the evaluation can be implemented in accordance with a speaker system, such as speaker system 100 of FIGS. 1A-1B or speaker system 300 of FIG. 3, to allow the speaker system to calibrate its microphone array to minimize voice reflections or other acoustic reflections from nearby surfaces that reduces voice recognition accuracy. Variations of method 400 or methods similar to method 400 can include a number of different embodiments that may be combined depending on the application of such methods and/or the architecture of systems in which such methods are implemented.

Embodiments described herein may be implemented in one or a combination of hardware, firmware, and software. Embodiments may also be implemented as instructions stored on one or more machine-readable storage devices, which may be read and executed by at least one processor to perform the operations described herein. A machine-readable storage device may include any non-transitory mechanism for storing information in a form readable by a machine, for example, a computer. For example, a machine-readable storage device may include read-only memory (ROM), random-access memory (RAM), magnetic disk storage media, optical storage media, flash-memory devices, and other storage devices and media.

In various embodiments, a machine-readable storage device comprises instructions stored thereon, which, when executed by a set of processors of a system, cause the system to perform operations, the operations comprising one or more features similar to or identical to features of methods and techniques described with respect to method 400, variations thereof, and/or features of other methods taught herein. The physical structures of such instructions may be operated on by the set of processors, which set can include one or more processors. Executing these physical structures can cause a speaker system to perform operations comprising operations to: determine distances of one or more surfaces to the speaker system in response to optical signals received by one or more optical sensors of the speaker system, the speaker system including a microphone array having multiple microphones; and adjust an algorithm to manage beamforming of an incoming voice signal to the speaker system based on the determined distances, or turn off selected one or more microphones of a microphone array based on the determined distances and adjust evaluation of the voice signal to the microphone array to account for the one or more microphones turned off.

Adjustment of the algorithm or selection of one or more microphones to turn off can include a comparison of the determined distance, for each surface of the one or more surfaces, with a threshold distance for a speaker system to a reflective surface. Adjustment of the algorithm can include adjustment of a weight of an input to the algorithm from each microphone of a number of microphones of the microphone array based the determined distances. Adjustment of the evaluation of the voice signal to the microphone array can include performance of the evaluation with the number of microphones in the evaluation reduced by the number of microphones turned off by defining evaluation parameters by the microphones of the microphone array that remain in an on status.

Variations of the abovementioned machine-readable storage device or similar machine-readable storage devices can include a number of different embodiments that may be combined depending on the application of such machine-readable storage devices and/or the architecture of systems in which such machine-readable storage devices are implemented.

In various embodiments, a system, having components to implement a speaker system with microphone room calibration can comprise: a microphone array having multiple microphones; one or more optical sensors; one or more processors; and a storage device comprising instructions, which when executed by the one or more processors, cause the speaker system to perform operations to: determine distances of one or more surfaces to the speaker system in response to optical signals received by the one or more optical sensors; and adjust an algorithm to manage beamforming of an incoming voice signal to the speaker system based on the determined distances, or turn off selected one or more microphones of the microphone array based on the determined distances and adjust evaluation of the voice signal to the microphone array to account for the one or more microphones turned off. The speaker system can have one or more speakers.

Variations of a system related to speaker system with microphone room calibration, as taught herein, can include a number of different embodiments that may be combined depending on the application of such systems and/or the architecture in which systems are implemented. Operations to adjust the algorithm or turn off selected one or more microphones can include a comparison of the determined distance, for each surface of the one or more surfaces, with a threshold distance for a speaker system to a reflective surface. Operations to adjust the algorithm can include adjustment of a weight of an input to the algorithm from each microphone of a number of microphones of the microphone array based the determined distances. Operations to adjust the algorithm can include retrieval of an algorithm, from the storage device, corresponding to a shortest distance of the determined distances and use of the retrieved algorithm to manage the beamforming of the incoming voice signal. Variations can include adjustment of the evaluation of the voice signal to the microphone array to include performance of the evaluation with the number of microphones in the evaluation reduced by the number of microphones turned off by defining evaluation parameters by the microphones of the microphone array that remain in an on status.

Variations of a system related to speaker system with microphone room calibration, as taught herein, can include each of the one or more optical sensors including an optical source and an optical detector. Each of the optical sources and optical detectors can be an infrared source and an infrared detector. The infrared signals can range in wavelength from about 750 nm to about 920 nm using standard sensors. The microphone array having multiple microphones can be a linear array disposed on or integrated in a housing of the speaker system or a circular array disposed on or integrated in a housing of the speaker system. The speaker system is a voice activated smart speaker system.

Variations of a system related to speaker system with microphone room calibration, as taught herein, can optionally include one or more acoustic sensors with each acoustic sensor having an acoustic transmitter and an acoustic receiver. The acoustic sensors can be used to provide additional information regarding surfaces determined from probing by the one or more optical sensors to be at respective distances from the speaker system. Acoustic signals generated by the acoustic transmitters and received by the acoustic receivers after reflection from the surfaces can vary due to the nature of the surface, in addition to distances from the surfaces. Hard surfaces tend to provide stronger reflected signals than softer surfaces. The analysis can be used with the data from the one or more optical sensors to map the room in which the speaker system is disposed. An acoustic sensor of the one or more acoustic sensors can be located with an optical sensor of the one or more optical sensors. Alternatively, microphones of the microphone array of the system and one or more speakers of the system can be used to provide the additional information regarding surfaces determined from probing by the one or more optical sensors.

Figure 5:
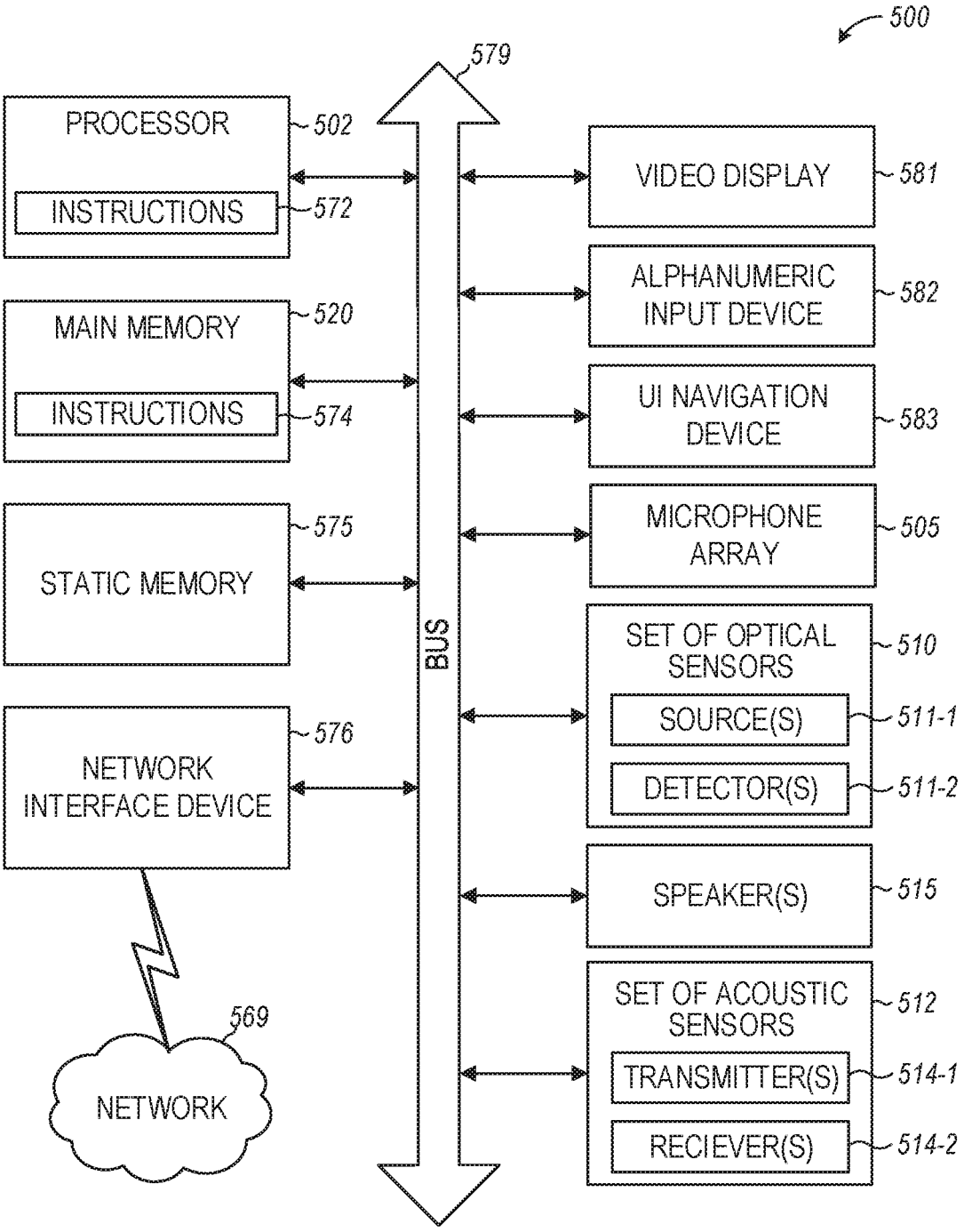
FIG. 5 is a block diagram illustrating features of an example speaker system having microphone room calibration, in accordance with various embodiments.

FIG. 5 is a block diagram illustrating features of an embodiment of an example speaker system 500 having microphone room calibration, within which a set or sequence of instructions may be executed to cause the system to perform any one of the methodologies discussed herein. Speaker system 500 may be a machine that operates as a standalone device or may be networked to other machines. In a networked deployment, speaker system 500 may operate in the capacity of either a server or a client machine in server-client network environments, or it may act as a peer machine in peer-to-peer (or distributed) network environments. Further, while speaker system 500 is shown only as a single machine, the term "system" shall also be taken to include any collection of machines that individually or jointly execute a set (or multiple sets) of instructions to perform any one or more of the methodologies discussed herein.

Speaker system 500 can include one or more speakers 515, one or more processors 502, a main memory 520, and a static memory 577, which communicate with each other via a link 579 (e.g., a bus). Speaker system 500 may further include a video display unit 581, an alphanumeric input device 582 (e.g., a keyboard), and a user interface (UI) navigation device 583 (e.g., a mouse). Video display unit 581, alphanumeric input device 582, and UI navigation device 583 may be incorporated into a touch screen display. A UI of speaker system 500 can be realized by a set of instructions that can be executed by processor 502 to control operation of video display unit 581, alphanumeric input device 582, and UI navigation device 583. Video display unit 581, alphanumeric input device 582, and UI navigation device 583 may be implemented on speaker system 500 arranged as a virtual assistant to manage parameters of the virtual assistant.

Speaker system 500 can include a microphone array 505 and a set of optical sensors 510 having source(s) 511-1 and detectors(s) 511-2, which can function similar or identical to the microphone array and optical sensors associated with FIGS. 1A-B and FIG. 3. Speaker system 500 may include a set of acoustic sensors 512 having transmitter(s) 514-1 and receiver(s) 514-2, which can function similar or identical to the set of acoustic sensors 312 associated with FIG. 3. Each acoustic sensor of the set of acoustic sensors 512 can be located with an optical sensor of the set of optical sensors 510. For example, each of optical sensors 110-1, 110-2 . . . 110-N of FIG. 1B can be replaced with an optical source 511-1 and optical detector 511-2 along with an acoustic transmitter 514-1 and an acoustic receiver 514-2.

Speaker system 500 can include a network interface device 576, and one or more sensors (not shown), such as a global positioning system (GPS) sensor, compass, accelerometer, or other sensor. The communications may be provided using a bus 579, which can include a link in a wired transmission or a wireless transmission.

Main memory 520 can include instructions 574 on which is stored one or more sets of data structures and instructions embodying or utilized by any one or more of the methodologies or functions described herein. Instructions 574 can include instructions to execute optical signal evaluation logic and a set of beamforming algorithms. Main memory 520 can be implemented to provide a response to automatic speech recognition for an application for which automatic speech recognition is implemented. Processor(s) 502 may include instructions to completely or at least partially operate speaker system 500 as an activated smart home speaker with microphone room calibration. Components of a speaker system with microphone room calibration capabilities and associated architecture, as taught herein, can be distributed as modules having instructions in one or more of main memory 520, static memory 575, and/or within instructions 572 of processor(s) 502.

The term "machine-readable medium" may include a single medium or multiple media (e.g., a centralized or distributed database, and/or associated caches and servers) that store the one or more instructions. The term "machine-readable medium" shall also be taken to include any tangible medium that is capable of storing instructions for execution by the machine and that cause the machine to perform any one or more of the methodologies taught herein or that is capable of storing data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks: and CD-ROM and DVD-ROM disks.

Instructions 572 and instructions 574 may be transmitted or received over a communications network 569 using a transmission medium via the network interface device 576 utilizing any one of a number of well-known transfer protocols (e.g., HTTP). Parameters for beamforming algorithms stored in instructions 572, instructions 574, and/or main memory 520 can be provided over the communications network 569. This transmission can allow for updating a threshold distance for a speaker system to a reflective surface. In addition, communications network 569 may operably include a communication channel propagating messages between entities for which speech frames can be transmitted and results of automatic speech recognition can be transmitted back to the source that transmitted the speech frames. Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any medium that is capable of carrying messages or instructions for execution by a machine and includes any medium that is capable of carrying digital or analog communications signals.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A speaker system comprising:

a microphone array having multiple microphones; one or more optical sensors; one or more processors;

a storage device comprising instructions, which when executed by the one or more processors, cause the speaker system to perform operations to:

determine distances of one or more surfaces to the speaker system in response to optical signals received by the one or more optical sensors, the one or more surfaces being part of a room in which the speaker system is located;

compare the determined distance, for each surface of the one or more surfaces, with a threshold distance;

turn off one or more selected microphones of the microphone array based on the determined distances and the comparison with the threshold distance for each surface of the one or more surfaces; and adjust evaluation of a voice signal detected by the microphone array to account for the one or more microphones turned off.

2. The system of claim 1, wherein the operations include adjustment of a weight of an input to an algorithm from each microphone of a number of microphones of the microphone array based on the determined distances, in response to the turn off of the selected one or more microphones of the microphone array.

3. The system of claim 1, wherein the operations include retrieval of an algorithm, from the storage device, corresponding to a shortest distance of the determined distances and use of the retrieved algorithm to manage beamforming of the voice signal, in response to the turn off of the selected one or more microphones of the microphone array.

4. The system of claim 1, wherein adjustment of the evaluation of the voice signal detected by the microphone array includes performance of the evaluation with a number of microphones in the evaluation reduced by a number of microphones turned off for defining evaluation parameters by the microphones of the microphone array that remain in an on status.

5. The system of claim 1, wherein each of the one or more optical sensors includes an infrared source and an infrared detector.

6. The system of claim 1, wherein the system includes one or more acoustic sensors with each acoustic sensor having an acoustic transmitter and an acoustic receiver.

7. The system of claim 1, wherein the microphone array having multiple microphones is a linear array disposed on or integrated in a housing of the speaker system or a circular array disposed on or integrated in a housing of the speaker system.

8. The system of claim 1, wherein the speaker system is a voice activated smart speaker system.

9. A processor implemented method comprising:

determining, using one or more processors, distances of one or more surfaces to a speaker system in response to optical signals received by one or more optical sensors of the speaker system, the one or more surfaces being part of a room in which the speaker system is located, the speaker system including a microphone array having multiple microphones;

comparing the determined distance, for each surface of the one or more surfaces, with a threshold distance;

turning off one or more selected microphones of a microphone array based on the determined distances and the comparison with the threshold distance for each surface of the one or more surfaces; and adjusting evaluation of a voice signal detected by the microphone array to account for the one or more microphones turned off.

10. The processor implemented method of claim 9, wherein the method includes adjusting a weight of an input to an algorithm from each microphone of a number of microphones of the microphone array based on the determined distances, in response to the turning off the selected one or more microphones of the microphone array.

11. The processor implemented method of claim 9, wherein the method includes retrieving, from a storage device, an algorithm corresponding to a shortest distance of the determined distances and using the retrieved algorithm to manage beamforming of the voice signal, in response to turning off the selected one or more microphones of the microphone array.

12. The processor implemented method of claim 9, wherein adjusting the evaluation of the voice signal detected by the microphone array includes performing the evaluation with a number of microphones in the evaluation reduced by a number of microphones turned off by defining evaluation parameters for the microphones of the microphone array that remain in an on status.

13. The processor implemented method of claim 9, wherein the optical signals are generated by optical sources of the one or more optical sensors and the optical signals are received by optical detectors of the one or more optical sensors.

14. The processor implemented method of claim 13, wherein the optical signals are infrared signals.

15. A machine-readable storage device comprising instructions, which, when executed by a set of processors, cause a speaker system to perform operations, the operations comprising operations to:

determine distances of one or more surfaces to the speaker system in response to optical signals received by one or more optical sensors of the speaker system, the one or more surfaces being part of a room in which the speaker system is located, the speaker system including a microphone array having multiple microphones;

compare the determined distance, for each surface of the one or more surfaces, with a threshold distance for a speaker system;

turn off one or more selected microphones of a microphone array based on the determined distances and the comparison with the threshold distance for each surface of the one or more surfaces; and adjust evaluation of a voice signal detected by the microphone array to account for the one or more microphones turned off.

16. The machine-readable storage device of claim 15, wherein the operations includes adjustment of a weight of an input to an algorithm from each microphone of a number of microphones of the microphone array based on the determined distances, in response to the turn off of the selected one or more microphones of the microphone array.

17. The machine-readable storage device of claim 15, wherein adjustment of the evaluation of the voice signal detected by the microphone array includes performance of the evaluation with a number of microphones in the evaluation reduced by a number of microphones turned off by defining evaluation parameters for the microphones of the microphone array that remain in an on status.

* * * * *